US006354472B1

(12) United States Patent
Bridges

(10) Patent No.: US 6,354,472 B1
(45) Date of Patent: Mar. 12, 2002

(54) FILAMENT STYLE GLUE APPLICATOR

(76) Inventor: Mark E. Bridges, 1 Pine Hill Rd., Spencerport, NY (US) 14559-1032

( * ) Notice: Subject to any disclaimer, the term of this patent is extended or adjusted under 35 U.S.C. 154(b) by 0 days.

(21) Appl. No.: 09/405,340

(22) Filed: Sep. 24, 1999

Related U.S. Application Data

(60) Provisional application No. 60/119,982, filed on Feb. 12, 1999.

(51) Int. Cl.[7] ..... B67D 5/42

(52) U.S. Cl. ..... 222/391; 222/146.5; 219/229

(58) Field of Search ..... 219/229, 227, 219/242, 420; 222/146.5, 321, 391, 325; 226/127, 167; 228/52, 53, 101

(56) References Cited

U.S. PATENT DOCUMENTS

| | | | | | |
|---|---|---|---|---|---|
| 2,119,462 | A | * | 5/1938 | Kull et al. | 113/109 |
| 2,692,935 | A | * | 1/1954 | Pearce et al. | 219/27 |
| 2,901,585 | A | * | 8/1959 | Baccari et al. | 219/27 |
| 3,008,863 | A | | 11/1961 | Morris et al. | |
| 3,337,093 | A | | 8/1967 | Newton | |
| 3,377,012 | A | | 4/1968 | Cushman | |
| 3,393,856 | A | | 7/1968 | Fortune | |
| 3,604,597 | A | * | 9/1971 | Pohl et al. | 222/146.5 |
| 3,707,258 | A | | 12/1972 | Schlitt | |
| 3,796,856 | A | * | 3/1974 | Wei-Cheng | |
| 3,966,109 | A | | 6/1976 | Hogan | |
| 4,138,048 | A | * | 2/1979 | Lemmon | 226/152 |
| 4,199,096 | A | * | 4/1980 | Keefe et al. | 228/52 |
| 5,236,626 | A | * | 8/1993 | Handy | 401/1 |
| 5,421,505 | A | * | 6/1995 | Hild, II | 228/41 |
| 5,462,206 | A | * | 10/1995 | Kwasie | 222/146.5 |

* cited by examiner

*Primary Examiner*—Joseph A. Kaufman
*Assistant Examiner*—M A Ccaantagenay
(74) *Attorney, Agent, or Firm*—Nixon Peabody LLP

(57) ABSTRACT

An applicator for glue includes a glue dispensing assembly and a housing with a barrel section, a handle section and a base. At least a portion of the glue dispensing assembly is located within the housing. The barrel section is adjacent to one end of the handle section and the base is adjacent to another end of the handle section. The base supports the handle section and the barrel section above a surface when the base is placed on the surface. A removable container for housing the glue to be dispensed is located at least partially within an opening in the base of the housing. The glue dispensing assembly includes a one glue dispensing tip located adjacent to one end of the barrel section of the housing and within the outer periphery of the base when the base is placed on the surface. The glue has a filament form factor of greater than about 100 and a ten watt heater or less is used.

27 Claims, 5 Drawing Sheets

FILAMENT STYLE GLUE APPLICATOR

This application claims the benefit of U.S. Provisional Patent Application Ser. No. 60/119,982, filed on Feb. 12, 1999 which is herein incorporated by reference.

FIELD OF THE INVENTION

The invention relates to glue applicators that dispense hot, melted glue for general purpose bonding.

BACKGROUND OF THE INVENTION

Typically, glue applicators have a gun-like shape with a handle portion and a barrel portion. A trigger actuated mechanism in the handle portion moves glue towards a heating chamber in the barrel portion. The glue usually comes in a cylindrical form and is breech-loaded into the glue applicator. A heater in the heating chamber melts the glue which has been advanced by the trigger actuated mechanism. The melted glue is then forcibly extruded from a nozzle or tip at the end of the barrel portion onto the desired location. The nozzle or tip diameters are usually about 0.65 inches in diameter or larger.

One of the problems with prior applicators is with the form of the glue being used. Typically, standard household and light duty commercial applicators use polyamide glue in the form of a 0.25, 0.31 and 0.44 inch diameter round or oval sticks. The sticks of glue used in these applicators are available in various lengths usually ranging between about two inches to ten inches. The use of longer sticks of glue results in less frequent refilling, but render the applicator unwieldy because a large portion of the glue stick hangs out the back of the applicator. This unbalanced condition adds an element of clumsiness to the manipulation of the applicator during glue application. As a result, accurate placement and control of the glue is more difficult and the wrist and hand of the user is more stressed. The use of shorter sticks of glue makes the applicator easier to handle and manipulate, but requires frequent reloading because the glue runs out more quickly.

Another problem with prior glue applicators is that once the glue is heated, but not being applied, the glue can dribble out of the tip onto the work surface, creating a mess. When the applicator is lifted, the glue 'strings'—that is, forms thread-like strands of glue that set-up immediately in the cooler air. The large blob of semi-liquid glue present at the tip continually 'feeds' the thread creating a mess on the work piece and the work surface. Even glue applicators equipped with a check valve to control dribble are subject to this phenomenon.

Yet another problem with prior glue applicators is what to do when the applicators are not being used to dispense glue, but will be used again shortly, i.e the glue in the applicator has been advanced to the heater and is melting or melted, but is not being dispensed. Some applicators have a wire bale that rotates down from under the tip to provide a precarious three-point stance with the butt of the handle. This technique does support the applicator, but does so in a very precarious manner. The applicator can readily tip over, especially when longer sticks of glue are used in the gun. Additionally, even when the tip is supported by a wire bale, the glue can still dribble out onto the work surface creating a mess. The mess is further compounded if in a subsequent operation the applicator is placed back into a puddle of dribbled glue. Some applicators have no support features whatever and are simply laid on their side.

Yet another problem with prior glue applicators is that relatively high wattage heaters are needed to melt the glue.

These higher wattage heaters are more expensive, require more power, still take a while to melt the glue, and generate a volume of heat which can be hazardous to the operator. Typically, a 40 watt heater is used in these prior applicators. Warm-up from room temperature to application temperature for glue in an applicator using 0.44 inch diameter round stick of glue with a forty watt heater can take up to eight minutes because of the shear volume of glue that must be heated. A few applicators which utilize 0.25 and 0.31 inch diameter "low temperature" sticks have more economical, lower wattage heaters in the ten to twenty watt range, however even these heaters are still expensive, require more power than is necessary, still take a while to melt the glue, and generate a volume of heat which can be hazardous to the operator.

SUMMARY OF THE INVENTION

An applicator for glue in accordance with one embodiment of the present invention includes a glue dispensing assembly and a housing with a barrel section, a handle section and a base. At least a portion of the glue dispensing assembly is located within the housing. The barrel section is adjacent to one end of the handle section and the base is adjacent to another end of the handle section. The base supports the handle section and the barrel section above a surface when the base is placed on the surface.

An applicator for glue in accordance with another embodiment of the present invention includes a glue dispensing assembly, a housing with a barrel section, a handle section, and a base, and a removable container. At least a portion of the glue dispensing assembly is located within the housing. The barrel section is adjacent to one end of the handle section and the base is adjacent to another end of the handle section. The removable container for housing the glue to be dispensed is located at least partially within an opening in the base of the housing.

An applicator for glue in accordance with another embodiment of the present invention includes a housing, a glue dispensing assembly located at least partially within the housing and glue located in the housing where the glue has a filament form factor of greater than about 100.

A replaceable container of glue for use in an applicator in accordance with yet another embodiment of the present invention includes a container housing with glue having a filament form factor of greater than about 100.

One of the advantages of the present invention is that the applicator provides a stable and convenient base to rest on a surface and support the handle and barrel sections of the applicator when in operation, but not dispensing glue. Additionally, the base supports the applicator in a manner making it easy to grasp and continue using the applicator. Further, by locating the removable container which houses the coil of glue in the base, weight is added to the base which promotes even more stability.

Another advantage of the present invention is that the applicator is designed to minimize the amount of glue which dribbles out and to control where any glue that dribbles out may land. The applicator includes a check valve to minimize the volume of glue dribble volume and a nozzle with a 0.04 inch diameter or smaller hole to minimize glue volume available for the stringing phenomenon. Additionally, the tip or nozzle of the applicator is designed to stay within the outer periphery of the base when the base is resting upon a surface. As a result, any glue which does dribble out will drip onto the base of the applicator, not on the work surface. Preferably, the base is constructed of a material which can be easily cleaned.

Another advantage of the present invention is that the applicator uses a lower wattage heater. The applicator melts glue at the same temperature as existing models, but because the volume of glue to be melted is far less, a small wattage heater can be used. This saves energy and keeps the radiated and conducted heat to a minimum. Because of the relatively small thermal mass, the operator's hand can get closer to the dispensing point at the tip, thereby increasing precision of the application. (One's hand can be quite close to the flame of a wooden match, but must be much farther away from a log burning in a fireplace. Both fires are burning at the same temperature, but the amount of heat energy is quite different.)

Another advantage of the present invention is that the applicator uses glue having a filament form factor of greater than about 100. Filament form factors are discussed in greater detail below. With a filament form factor of greater than about 100, the glue can be easily coiled and stored in a replaceable container which can be easily snapped into place into the applicator. Additionally, since the glue can be coiled, a large amount of glue can be stored within the applicator for use. As a result, the operator can use the applicator for a much longer period of time without running out of glue. Further, the thinner glue takes less time and energy to heat to a melting point. Even further, the smaller volume of glue being dispensed enables the operator to more precisely dispense glue.

DETAILED DESCRIPTION OF THE INVENTION

Figure 1:
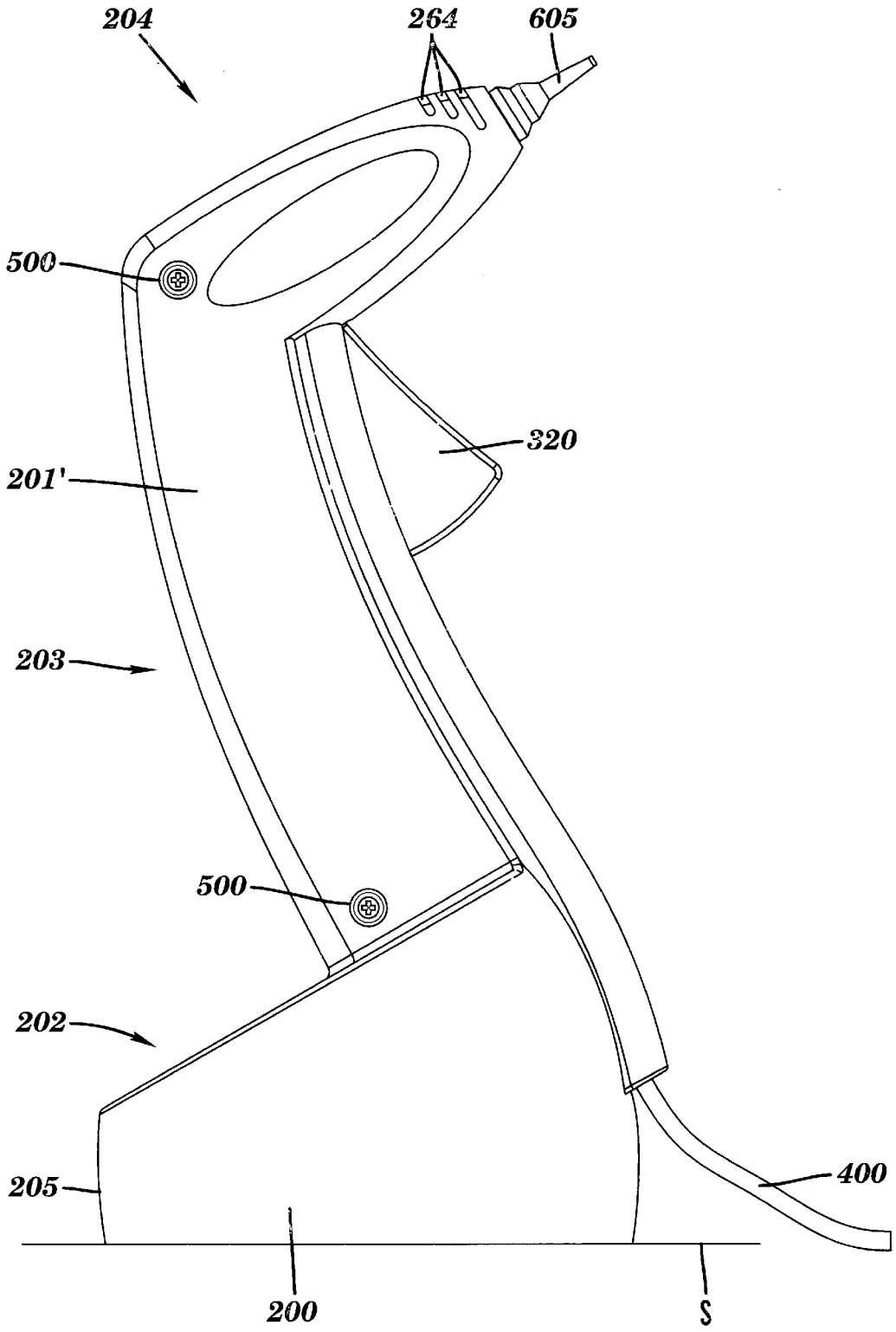
FIG. 1 is a plan view of an applicator in accordance with one embodiment of the present invention.

A glue applicator 200 in accordance with one embodiment of the present invention is illustrated in FIG. 1. The glue applicator 200 includes a glue dispensing assembly and a housing 290 with a barrel portion or section 204, a handle portion or section 203 and a base 202. The base supports the handle section and the barrel section 204 above a surface when the base 202 is placed on the surface. Preferably, the glue 102 has a filament form factor of at least 100. The present invention provides a number of advantages including providing an applicator 200 which is easier to use, more stable when placed on a surface, and minimizes problems from any excess glue 102 dripping out of the applicator 200.

Referring to FIG. 1, a glue applicator 200 in accordance with one embodiment of the present invention is illustrated. In this particular embodiment, the glue applicator 200 includes the base 202, handle portion 203, and barrel portion 204 which are integrally formed together, although the base 202, handle portion 203, and barrel portion 204 could be separate sections which are connected together.

The applicator 200 is loaded with glue 102 which preferably has a filament form factor or slenderness ratio of about 100 or more to allow it to be easily wound into a coil. A "filament form factor" or slenderness ratio is measurement of the length (L) of an object divided by the diameter (D) of the object, i.e. L÷D. Assuming a stick of glue 102 has a given length (L) of 10 inches and a diameter (D) of 0.44 inches, the glue 102 has a slenderness ratio of 10"÷0.44"=23, which is much too stiff to coil into a convenient package. A stick of glue 102 having a length (L) of ten inches and a diameter (D) of 0.25 inches has a slenderness ratio of 10"÷0.25"=40, which is still much too stiff to coil into a convenient package. However, a stick of glue 102 having a length (L) of 10 inches and a diameter (D) of 0.08 inches has a slenderness ratio of 10"÷0.08"=125. This ratio provides inherent flexibility to the glue 102. As a result, the glue 102 can be easily wound into a coil for use in the applicator 200.

Figure 2:
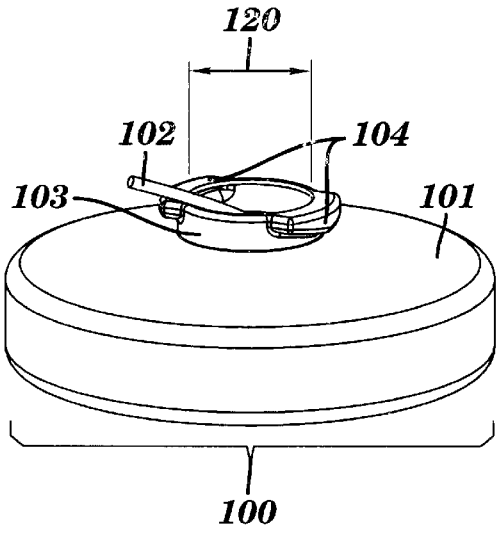
FIG. 2 is a perspective view of the top of a glue container and a coil of glue.

Referring to FIG. 2, a replaceable cartridge or container assembly 100 that holds the glue 102 for the applicator 200 is illustrated. The cartridge assembly 100 has a short, hollow cylindrical container 101 in which the glue 102 is coiled. The top of container 101 necks down to form an upper cylindrical portion 103, which has an opening 120 through which the glue 102 can be withdrawn and fed into the applicator 200. In this particular embodiment, two opposed tapered lugs 104 are located on the upper cylindrical portion 103 adjacent the opening 120 which form part of a bayonet-type connection system that is used to secure the cartridge assembly 100 within the opening in the base 202 of the applicator, although other types of connection systems can be used as needed or desired.

Figure 3:
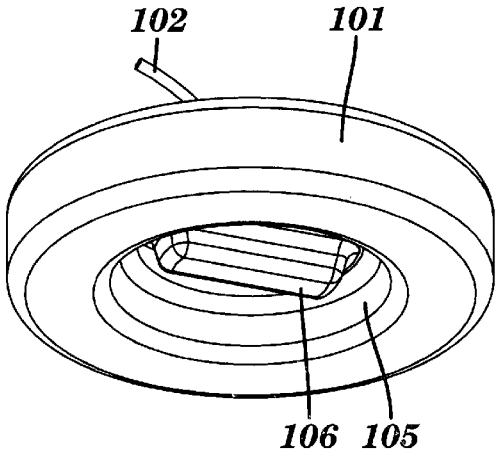
FIG. 3 is a perspective view of the bottom of the glue container and the coil of glue.

Referring to FIG. 3, the bottom of container 101 has a semi-cylindrical internally recessed portion 105 about which the glue 102 is wound and guided as it enters (during manufacture) and leaves (during use) the container 101, although the shape of the container 101 can vary as needed or desired. Central to recessed portion 105 and aligned with tapered lugs 104 is a re-emergent rectangular portion which acts as a handle 106 for cartridge assembly 100. The corners are rounded to promote sliding of the glue 102 within the container 101. In this particular embodiment, the container 101 may be made of a variety of different materials, such as High Density Polyethylene (HDPE), although other materials can be used as needed or desired. Preferably, the container 101 is made of a transparent or slightly translucent material so that a user or operator can visually check how much glue 102 is left within the container, although the translucency of the container 101 can vary as needed or desired. Although one particular shape and configuration is shown for cartridge assembly 100, the cartridge assembly 100 can have other shapes and configurations as needed or desired.

Figure 4A:
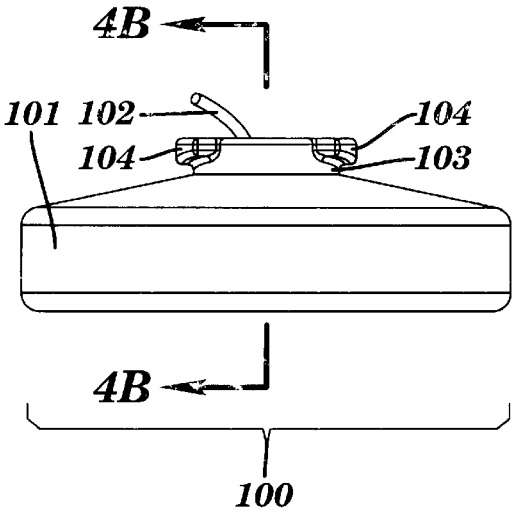
FIG. 4A is a plan view of the container and the coil of glue.
Figure 4B:
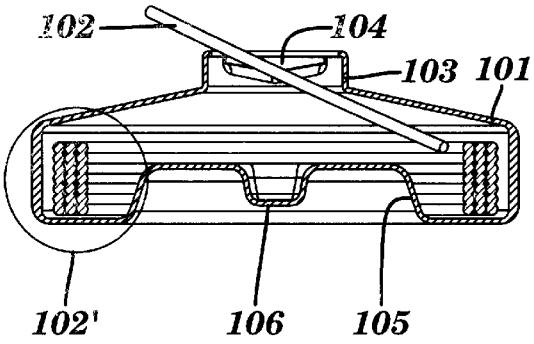
FIG. 4B is a cross-sectional of the container and the coil of glue shown in FIG. 4A taken along line 4B—4B in FIG. 4A.

Referring to FIGS. 4A and 4B, one example of the container 101 loaded with glue 102 is illustrated. In this particular example, twenty-five feet or more of 0.08 inch diameter glue 102 is easily coiled directly around the inner perimeter of container 101, which in this example is approximately 0.625 inches tall by 3 inches in internal diameter, thus forming a ring of glue 102' which contains approximately the same mass as a 10 inch length of 0.44 inch diameter glue stick. In this example the glue 102 has a filament form factor of 125. The length and diameter of the glue 102 stored in the container 101 can vary as needed or desired as long as the glue 102 has a filament form factor of about 100 or more.

The cartridge assembly 100 provides a number of advantages including providing an easy and convenient manner for installing glue 102 into the applicator 200. Additionally, by locating the cartridge assembly 100 in the base 202 of the applicator, the additional weight of the container 101 and the glue 102 in the base 202, helps to make the applicator 200 even more stable when the applicator 200 is placed on a surface.

Figure 5:
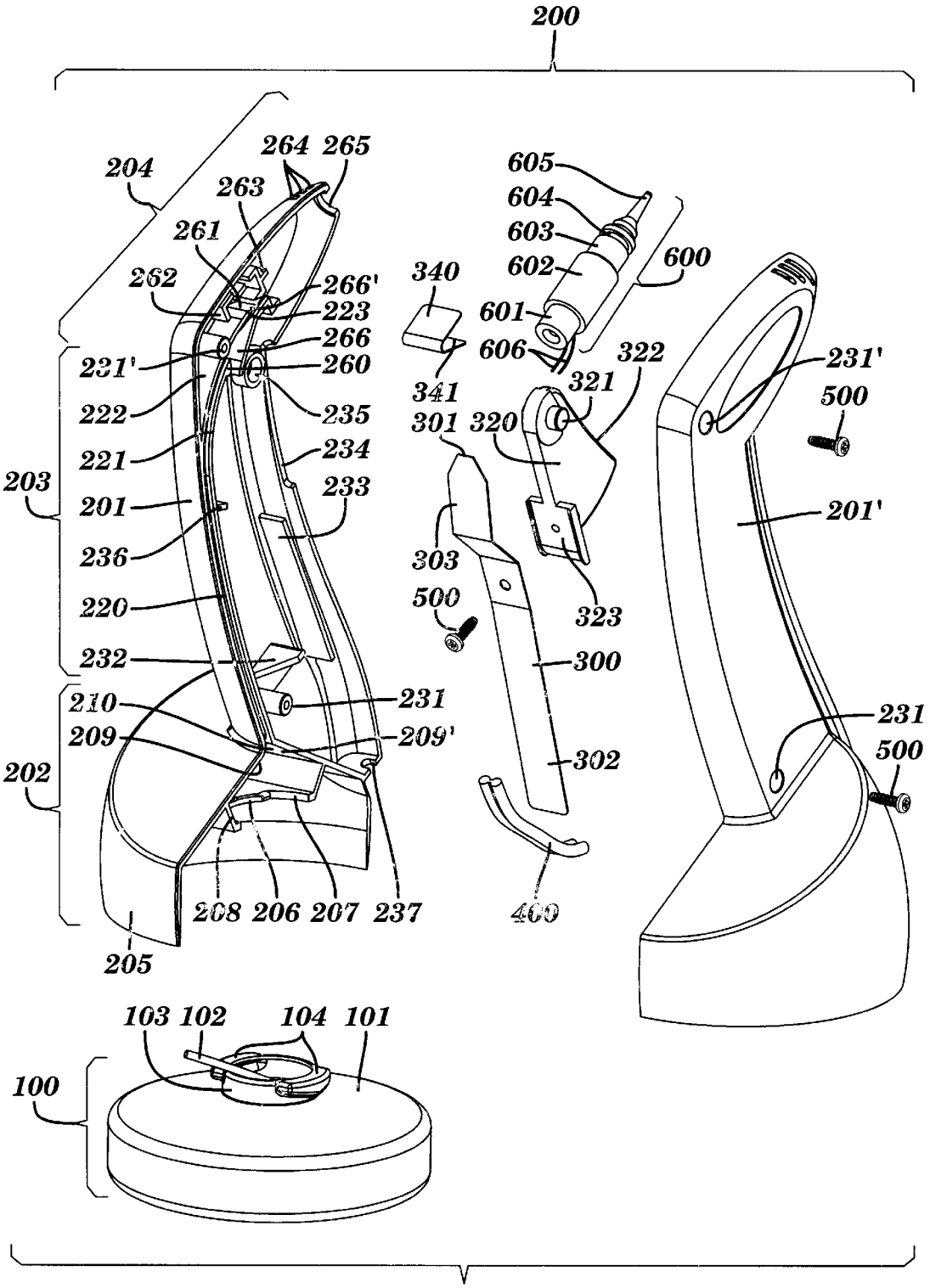
FIG. 5 is an exploded view of the applicator.

Referring to FIG. 5, an exploded view of one embodiment of the applicator 200 is illustrated. Left casing 201 has a mirrored counterpart in the form of a right casing 201', which is identical to the left casing 201 except as set forth below. In this particular embodiment, the casings 201 and 201' are injection molded from a heat resistant plastic material such as glass filled nylon 6/10 which can resist temperatures of 400° F. or better, although other types of techniques for making the casings 201 and 201' and other materials can be used for the casings 201 and 201' as needed or desired.

In this particular embodiment, two fastener bosses 231 and 231' on left casing 201 receive the threaded portion of fasteners 500 from casing 201 to secure the casings 201 and 201' together, although other types of securing devices to connect the casings 201 and 201' together can be used as needed or desired.

As discussed earlier, the casings 201 and 201' have a base portion 202, a handle portion 203, and a barrel portion 204. In this particular embodiment, the base portion 202 has a skirt 205 which is sized to receive the container 101, although base portion 202 could have other shapes and configurations to receive the container 101. Additionally, in this particular embodiment the skirt 205 extends below the container 101 and provides support for the applicator 200 when not in use. More specifically, when the base portion 202 is resting on a surface S, the base portion 202 supports the handle portion 203 and the barrel portion 204 off of the surface. In this position, the applicator 200 is in a safe and stable position while not being used by the operator. Additionally, the base portion 202 supports the barrel portion 204 so that the end of nozzle 605 does not extend past the outer periphery of base portion 202. As a result, any glue escaping from nozzle 605 drips on the base portion 202, not on the work surface S where it is easier to clean and less likely to cause a bigger mess.

Also within the base portion 202 is a cylindrical opening 206 and two arcuate openings 207 to receive the cylindrical portion 103 and lugs 104 of the container 101 respectively, in a manner well known to one of ordinary skill in the art, thus completing the bayonet attachment system. In this particular embodiment, a stop 208 is positioned to limit rotation of the lugs 104 to 90°. Again, although one type of connection system for connecting the container 101 in the base portion 202 is shown, other types of connection systems can be used as needed or desired.

Figure 6B:
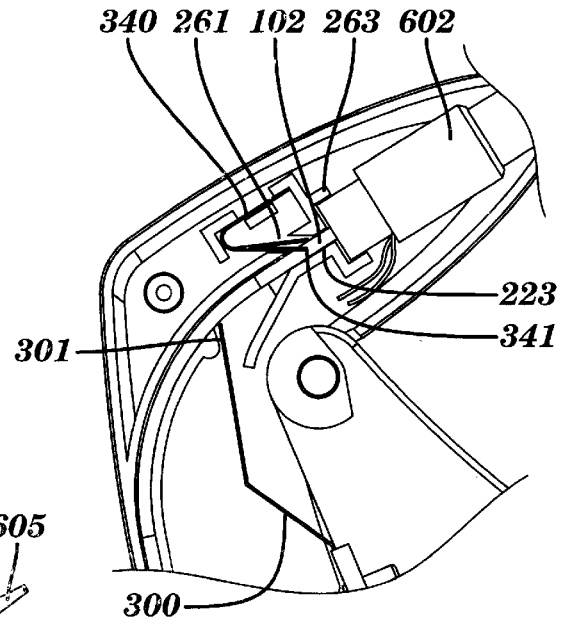
FIG. 6B is an enlarged, side view of a portion of the one half of the applicator.
Figure 6A:
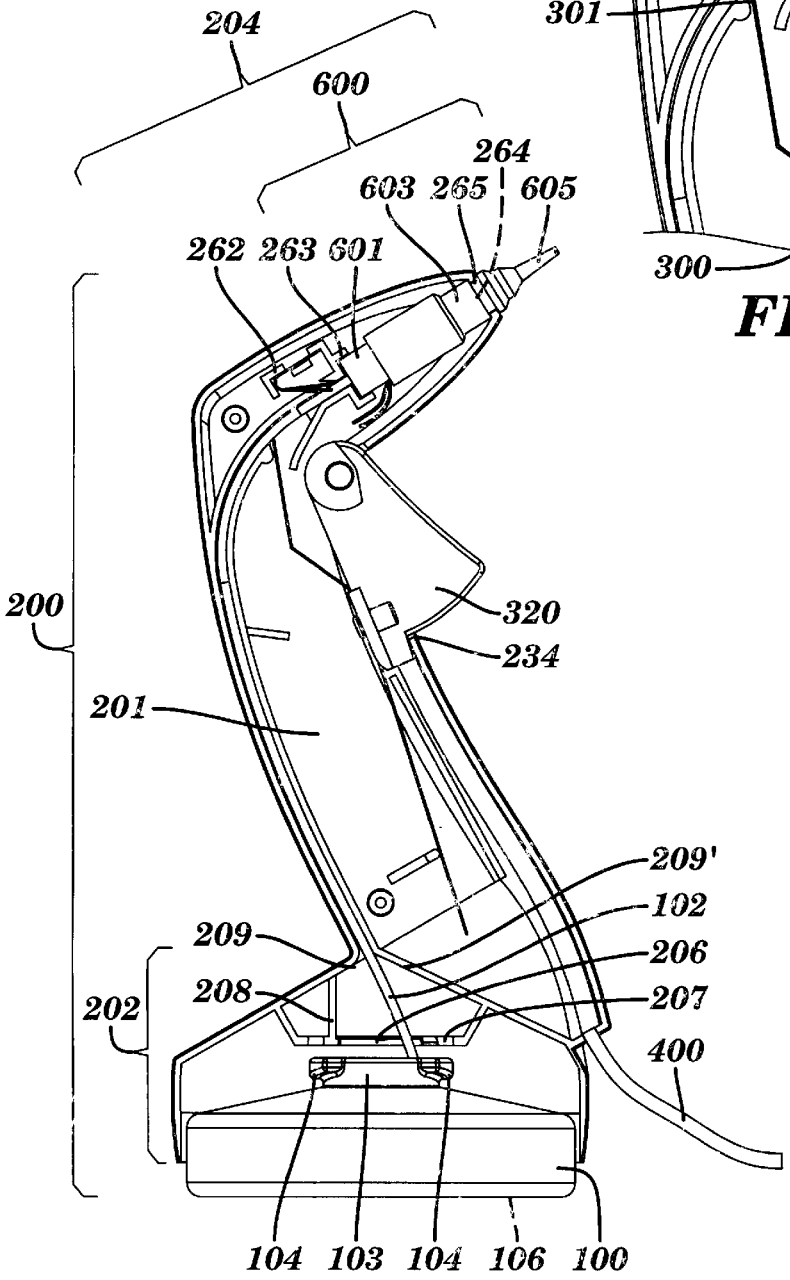
FIG. 6A is an internal, side view of one half of the applicator with the applicator components in their operating positions.

Referring to FIGS. 5 and 6A, two funnel faces 209 and 209' lead to a funnel opening 210 in the handle portion 203 of the casings 201 and 201'. The funnel faces 209 help to guide the glue 102 towards a tube structure 220. The tube structure 220 extends along the back spine of handle portion 203 and is used to guide the glue 102. A spring lug 232, a cord guide 233, a trigger passage 234, a trigger pivot boss 235, a trigger stop 236, and a power cord passage 237 are also molded into the handle portion 203 of the casings 201 and 201' in this particular example.

The tube structure 220 diverges from the back spine of handle portion 203 and curves towards the central axis of barrel portion 204 where the lower wall 221 of tube structure 220 ends at trigger spring passage 260. Upper wall 222 of tube structure 220 ends at anti-backup spring passage 261. A second lower wall portion 223 is located opposite anti-backup spring passage 261. Anti-backup spring lug 262, heater support features 263, radial vents 264, nozzle aperture 265, and funnel shaped walls 266, 266' are additionally molded into barrel portion 204 of casings 201 and 201' in this particular example. Although one type of structure is shown for guiding the glue 102 from the container 101 towards the heating assembly 600, other types of structures for guiding the glue 102 can be used as needed or desired.

A trigger spring 300 is made from a strip of springy material, such as 0.012 inch thick high carbon steel, although trigger spring 300 can be made of other materials as needed or desired. Trigger spring 300 is formed to include a tip 301 for engaging the glue 102, a tip spring portion 303, and a leaf spring portion 302 which slidably impinges on spring lug 232 in the casings 201 and 201'.

A trigger 320 is injection molded from a heat resistant plastic material, such as glass filled nylon 6/10 which can resist temperatures of 400° F. or better, although trigger 320 can be made by other techniques and of other materials as needed or desired. Trigger 320 also has two opposed pivot posts 321 which are received by pivot bosses 235 in left and right casings 201 and 201', a finger engagement area 322, and a trigger spring support face 323. In this particular embodiment, trigger 320 is secured to trigger spring 300 by a fastener 500, although other securing devices could be used as needed or desired.

An anti-backup spring 340 is a V-shaped piece of springy material, such as 0.006 inch thick high carbon steel, although other types of materials can be used for spring 240 as needed or desired. Anti-backup spring 340 is formed so tip 341 fits into anti-backup spring passage 261 and its body is retained by anti-backup spring lug 262 in casings 201 and 201' in this example.

A trigger spring 300 is located inside of casings 201 and 201' with leaf spring portion 302 slidably impinging on spring lug 232. Trigger 320 is coupled to trigger spring 300, has pivot posts 321 which are rotatably mounted in pivot bosses 235 and protrudes through trigger passage 234. Anti-backup spring 340 is positioned in casing s 201 and 201' as described above. Although one type of glue advancement assembly is shown and discussed above, other types of assemblies for advancing the glue 102 out from the container 101 towards the heater assembly 600 with different types of components can be used as needed or desired.

A power cord 400 enters the casings 201 and 201' via a power cord passage 237 and passes within the cord guide 233 and under trigger 320, when installed. The power cord has a strain relief (not shown) and is suitable for household electrical power of 110 VAC, 50/60 Hz and capable of delivering the sustained current required to drive a ten watt resistive heater. Although one type of power source supplied by a power cord 400 is shown for delivering power to the applicator 200, other types of power sources, such as batteries, could also be used in place of power cord 400.

In this particular embodiment, a heater assembly 600 is composed of a dam 601 made of a material, such as high temperature grade of silicone rubber, a resistive heater 602, such as a ten watt capacity heater encased in a protective ceramic or metal casing, a check valve assembly 603 which contains a stainless steel ball and spring (not shown), and an aluminum nozzle 605 that is powder coated with a colored pigment intended as a cautionary display, such as yellow. Preferably, nozzle 605 has a diameter of about 0.05 inches or less, although the diameter can vary as needed for the particular application. The smaller nozzle size helps to reduce the amount of glue which may dribble out of the applicator 200. The joint between check valve 603 and nozzle 605 creates a mounting groove 604. Electrical leads 606 are provided for electrical connection to the power cord 400 in a manner well known to those of ordinary skill in the art. Heater assembly 600 is located within the barrel portion 204 of the applicator 200. More specifically, mounting groove 604 is positioned within nozzle aperture 265 and heater 602 is retained in heater support features 263 when casings 201 and 201' are secured together. Although one type of heater assembly 600 is shown, other types of heater assemblies with other types of components and made of other types of materials can be used as needed or desired.

The loading and operation of the applicator 200 will be discussed with reference to FIGS. 5, 6A, 6B, 7A, and 7B. First, to load the glue applicator 200, approximately 10 inches of glue 102 is drawn from the container 101, and the free end of the glue is guided by funnel faces 209, 209' towards funnel opening 210 and into tube structure 220.

As shown in FIGS. 6A and 6B, tip 301 of trigger spring 300 is arranged so that the free end of glue 102 passes above it when the trigger 320 is not depressed. Continued pressure on glue 102 forces the free end to deflect the tip 341 of anti-backup spring 340 out of anti-backup spring passage 261. Tip 341 is sized and positioned to cooperate with second lower wall 223 so that glue 102 must deflect tip 341 as it passes between the two features. The slight deflection of tip 341 by the glue 102, and the impingement thereon, causes the tip 341 to act like a ratchet device, allowing foreword motion of glue 102 towards heater assembly 600, but inhibiting rearward motion. The free end of glue 102 has reached this engaged state when a slight tug on the glue 102 produces no rearward movement.

Next, cartridge handle 106 is used to align cylindrical portion 103 and lugs 104 of cartridge 100 to the cylindrical opening 206 and arcuate openings 207 in base portion 202 of applicator 200. Once cartridge 100 is in place, cartridge 100 is rotated clockwise about 90°, or until lugs 104 encounter stop 208. If slightly too much glue 102 has been withdrawn from cartridge 100, the space between funnel faces 209, and 209' and the planar element containing cylindrical opening 206 and arcuate openings 207 is designed to accommodate the extra glue 102. If so much glue 102 has been withdrawn that the cartridge 100 will not dock with in the base portion 202 of the applicator 200, then some excess glue 102 must be re-inserted into cartridge 100 by hand before attempting to dock again.

Meanwhile, heater 602 is energized and in this particular embodiment raises the temperature of the entire heater assembly 600 to about 300° F. when plug (not shown) at the end of power cord 400 is plugged into a 110 VAC 50/60 Hz power source although the particular amount of heat and power source can vary as needed or desired. Heat from the heater melts any glue adjacent to or in the check valve 603 and nozzle 605. Check valve 603 works in such a way as to seal any glue 102 within the heater assembly 600 that may exude from the nozzle 605 due to thermal expansion of the glue 102, yet allows glue 102 to flow into the nozzle 605 when trigger 320 is depressed. Similarly, glue dam 601 inhibits undesired blow-back of hot glue 102 out of the heater assembly 600 and into barrel portion 204 of applicator 200. When applicator 200 is hot, air is drawn into barrel portion 204 around trigger passage 234 by convection, and vents 264 allowing excess heat to escape. By using glue 102 with a filament form factor of about 100 or more, a fairly thin or narrow stick of glue 102 is being melted by the heater assembly 600 at one time. As a result, less heat is required to melt the glue 102 which is more economical and also enables the operator to get much closer to the nozzle 605 without getting burned. This allows for much more precise placement of the glue 102 with this applicator 200.

Figure 7B:
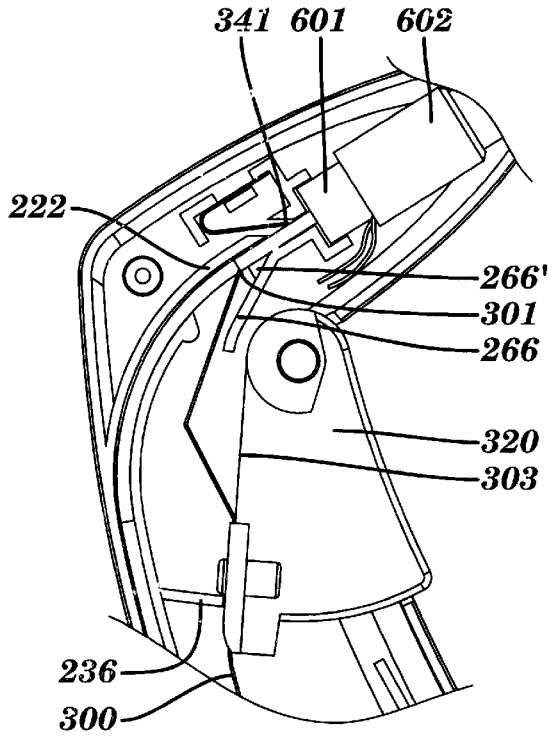
FIG. 7B is an enlarged, side view of a portion of the one half of the applicator.
Figure 7A:
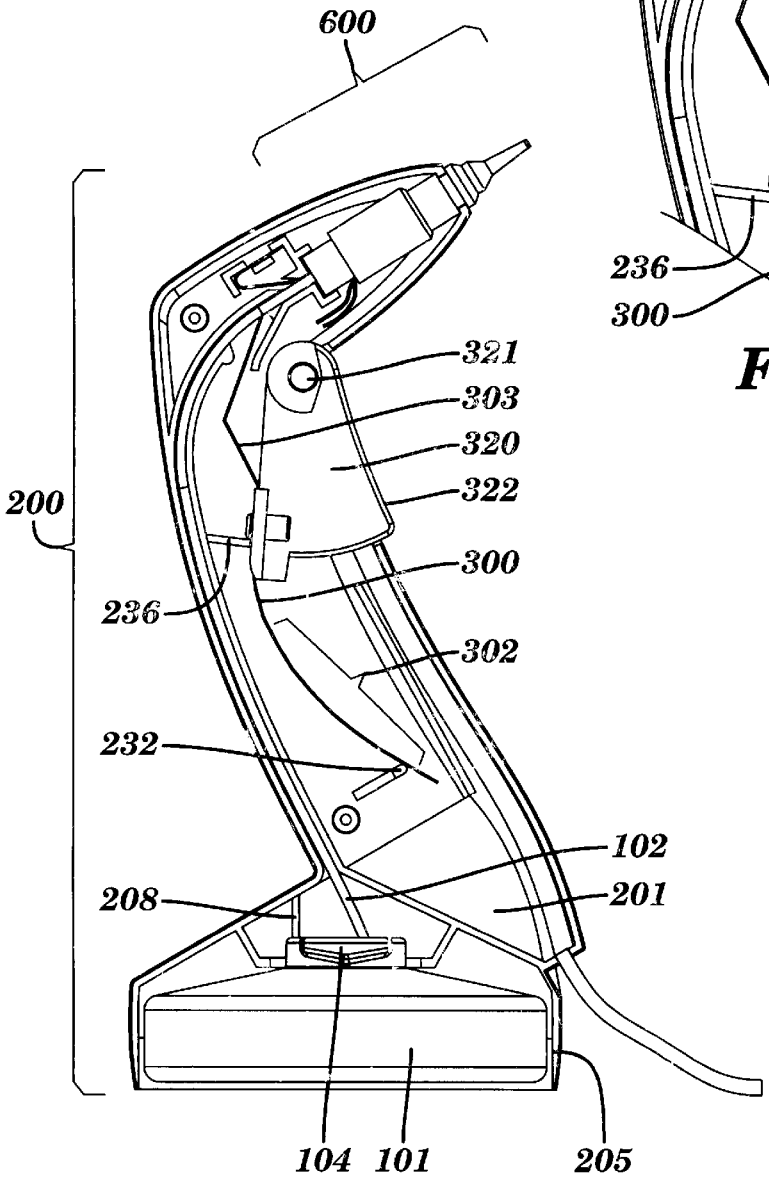
FIG. 7A is an internal, side view of one half of the glue applicator with the applicator components interacting with the glue.

Once the applicator 200 is loaded with glue 102 and the heater assembly 600 has been energized to start melting any supplied glue 102 as shown in FIGS. 7A and 7B, the applicator 200 is now ready for gluing operations. When the operator needs to dispense glue 102, trigger 320 at the finger engagement area 322 is pressed which advances the glue 102 into the heater assembly 600. More specifically, when trigger 320 is pressed, trigger 320 rotates about pivot posts 321, the rotation of which, in turn, causes the tip 301 of trigger spring 300 to also rotate until it encounters glue 102. The angle of attack and the path of travel of the tip 301 are such that when the tip 301 engages the glue 102, it digs into the surface of glue 102. Glue 102 is prevented from moving away from tip 301 by upper wall 222 of casings 201 and 201'. Continued rotational travel of trigger 320 draws glue 102 out of container 101 and forces it past anti-backup spring tip 341, through dam 601, and into heater element 602. The stroke of trigger 320 is complete when it encounters trigger stop 236 molded into casings 201 and 201'. Leaf spring portion 302 of trigger spring 300 impinging on spring lug 232 of casings 201 and 201' returns trigger 320 to its start position. If glue 102 cannot be advanced into heater element because it is not warmed up yet, tip spring 303 of trigger spring 300 deflects until trigger stop 236 is encountered. Multiple short strokes may be used to advance glue 102 because it is continually engaged with anti-backup spring tip 341 which prevents any rearward movement.

The resistive heater 602 melts the portion of the glue 102 which has been advanced into the heater assembly. The melted glue 102 is then dispensed from tip 605 to the desired location by the operator.

Between uses, but while still plugged in, the base portion 202, in particular the bottom of skirt 205, of the applicator 200 may be conveniently and safely be placed on a surface to support the handle portion 203 and barrel portion 204 above the surface. When placed on a surface, the tip of the nozzle 605 is designed to lie within the outer periphery of the base portion 202. As a result, if there is any glue dripping from nozzle 605, the glue will drip on the outer surface of base portion 202 and not on the work piece or work area. Preferably, the base portion 202 is made of a material which is easy to clean.

In this particular embodiment, container 101 is made of a translucent or clear material so the operator can view how much glue 102 is left, and can judge when replacement will be necessary, although non-translucent materials can be used. When glue 102 can no longer be advanced by tip 301, cartridge 101 is removed by simply revolving cartridge 101 about 90° counterclockwise using handle 106 until lugs 104 encounter stops 208. Cartridge 101 is then withdrawn axially from skirt 204 and a new supply of glue 102 in a new container 101 may then be loaded as described above. With applicator 200 at operating temperature, funnel-shaped walls 266, 266' adjacent to the trigger spring passage 260 guide new glue 102 free end towards remaining stub of previous glue 102, and force it into heater assembly 600 until new free end of glue 102 is captured under antibackup spring tip 341. Operation and use of applicator 200 then proceeds again as described above.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. An applicator for glue comprising:

a glue dispensing assembly; and a housing with a barrel section, a handle section and a base, at least a portion of the glue dispensing assembly located within the housing;

the barrel section adjacent to one end of the handle section;

the base adjacent to another end of the handle section, the base supporting the handle section and the barrel section above a surface when the base is placed on the surface;

wherein the glue dispensing assembly comprises at least one glue dispensing tip located at least partially in and adjacent to one end of the barrel section of the housing, wherein the glue dispensing tip is located within an axis extending perpendicularly from an outer periphery of the base when the base is placed on the surface.

2. The applicator as set forth in claim 1 wherein the diameter of an aperture for the glue dispensing tip is less than about 0.05 inches in diameter.

3. The applicator as set forth in claim 1 wherein the glue dispensing assembly further comprises:

at least one heater located in the barrel section of the housing before the glue dispensing tip; and a glue advancing assembly located in the housing which advances the glue towards the heater and the glue dispensing tip when actuated.

4. The applicator as set forth in claim 3 wherein the glue advancing assembly comprises:

a tube shaped structure in the housing which guides the glue at least a portion of the way from the base towards the heater; and a glue movement assembly which engages and advance the glue along the tube shaped structure.

5. The applicator as set forth in claim 1 further comprising a removable container for housing the glue to be dispensed located at least partially within an opening in the base of the housing.

6. The applicator as set forth in claim 5 wherein the glue in the container has a filament form factor of greater than about 100.

7. An applicator for glue comprising:

a glue dispensing assembly;

a housing with a barrel section, a handle section, and a base, at least a portion of the glue dispensing assembly located within the housing;

the barrel section adjacent to one end of the handle section and the base adjacent to another end of the handle section; and a removable container for housing the glue to be dispensed located at least partially within an opening in the base of the housing.

8. The applicator as set forth in claim 7 wherein the glue in the container has a filament form factor of greater than about 100.

9. The applicator as set forth in claim 7 wherein the glue dispensing assembly comprises:

at least one glue dispensing tip located in and adjacent to one end of the barrel section of the housing;

at least one heater located in the barrel section of the housing before the glue dispensing tip; and a glue advancing assembly located in the housing which advances the glue towards the heater and the glue dispensing tip when actuated.

10. The applicator as set forth in claim 9 wherein the glue dispensing tip is located within an axis extending perpendicularly from an outer periphery of the base when the base is placed on a surface.

11. The applicator as set forth in claim 9 wherein a diameter of an aperture for the glue dispensing tip is less than 0.05 inches in diameter.

12. The applicator as set forth in claim 9 wherein the glue advancing assembly comprises:

a tube shaped structure in the housing which guides the glue at least a portion of the way from the base towards the heater; and a movement assembly which engages and advance the glue along the tube shaped structure.

13. The applicator as set forth in claim 7 wherein the glue dispensing assembly comprises:

at least one means for dispensing located in and adjacent to one end of the barrel section of the housing;

at least one heater located in the barrel section of the housing before the means for dispensing; and a glue advancing assembly located in the housing which advances the glue towards the heater and the means for dispensing when actuated.

14. The applicator as set forth in claim 13 wherein the means for dispensing is located within an axis extending perpendicularly from an outer periphery of the base when the base is placed on a surface.

15. The applicator as set forth in claim 13 wherein a diameter of an aperture for the means for dispensing is less than 0.05 inches in diameter.

16. An applicator for glue comprising:

a glue dispensing assembly;

a housing with a barrel section, a handle section and a base, at least a portion of the glue dispensing assembly located within the housing; and glue in the housing, the glue having a filament form factor of greater than about 100, wherein the glue dispensing assembly comprises at least one glue dispensing tip located in and adjacent to one end of the barrel section of the housing, at least one heater located in the barrel section of the housing before the glue dispensing tip, and a glue advancing assembly located in the housing which advances the glue towards the heater and the glue dispensing tip when actuated and wherein the glue dispensing tip is located within an axis extending perpendicularly from an outer periphery of the base when the base is placed on a surface.

17. The applicator as set forth in claim 16 further comprising a removable container for housing the glue to be dispensed located at least partially within the housing.

18. The applicator as set forth in claim 16 wherein a diameter of an aperture for the glue dispensing tip is less than 0.05 inches in diameter.

19. The applicator as set forth in claim 16 wherein the glue advancing assembly comprises:

a tube shaped structure in the housing which guides the glue at least a portion of the way from the base towards the heater; and a movement assembly which engages and advance the glue along the tube shaped structure.

20. An applicator for glue comprising:

a glue dispensing assembly; and a housing with a barrel section, a handle section and a base, at least a portion of the glue dispensing assembly located within the housing;

the barrel section adjacent to one end of the handle section;

the base adjacent to another end of the handle section, the base supporting the handle section and the barrel section above a surface when the base is placed on the surface;

wherein the glue dispensing assembly comprises at least one means for dispensing located at least partially in and adjacent to one end of the barrel section of the housing, wherein the means for dispensing is located within an axis extending perpendicularly from an outer periphery of the base when the base is placed on the surface.

21. The applicator as set forth in claim 20 wherein the diameter of an aperture for the means for dispensing is less than about 0.05 inches in diameter.

22. The applicator as set forth in claim 20 wherein the glue dispensing assembly further comprises:

at least one heater located in the barrel section of the housing before the means for dispensing; and a glue advancing assembly located in the housing which advances the glue towards the heater and the means for dispensing when actuated.

23. The applicator as set forth in claim 22 wherein the glue advancing assembly comprises:

a tube shaped structure in the housing which guides the glue at least a portion of the way from the base towards the heater; and a glue movement assembly which engages and advances the glue along the tube shaped structure.

24. The applicator as set forth in claim 20 further comprising a removable container for housing the glue to be dispensed located at least partially within an opening in the base of the housing.

25. The applicator as set forth in claims 24 wherein the glue in the container has a filament form factor of greater than about 100.

26. An applicator for glue comprising:

a glue dispensing assembly;

a housing with a barrel section, a handle section and a base, at least a portion of the glue dispensing assembly located within the housing; and glue in the housing, the glue having a filament form factor of greater than about 100, wherein the glue dispensing assembly comprises at least one means for dispensing located in and adjacent to one end of the barrel section of the housing, at least one heater located in the barrel section of the housing before the means for dispensing, and a glue advancing assembly located in the housing which advances the glue towards the heater and the means for dispensing when actuated and wherein the means for dispensing is located within an axis extending perpendicularly from an outer periphery of the base when the base is placed on a surface.

27. The applicator as set forth in claim 26 wherein a diameter of an aperture for the means for dispensing is less than 0.05 inches in diameter.

* * * * *